United States Patent [19]

Breslow et al.

[11] 4,082,268

[45] Apr. 4, 1978

[54] BALL GAME WITH ALIGNABLE APERTURES

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 723,796

[22] Filed: Sep. 16, 1976

[51] Int. Cl.[2] ..... A63F 7/02

[52] U.S. Cl. ..... 273/1 R; 273/113; 273/117

[58] Field of Search ..... 273/119 A, 123 R, 118 D, 273/118 R, 113, 108, 136 F, 117, 1 R; 84/404

[56] References Cited

U.S. PATENT DOCUMENTS

| | | | |
|---|---|---|---|
| 1,522,307 | 1/1925 | Lewis | 273/116 |
| 2,098,417 | 11/1937 | Fisher | 273/11D |
| 3,488,052 | 1/1970 | Weisbecker | 273/1 R |
| 3,589,231 | 6/1971 | Postel | 84/404 |

FOREIGN PATENT DOCUMENTS

| | | | |
|---|---|---|---|
| 1,100,255 | 1955 | France | 273/110 |
| 152,518 | 1920 | United Kingdom | 273/131 B |

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

A game apparatus which includes a base for positioning on a supporting surface and having an upper playing surface for supporting at least one playing piece for movement thereof. The playing surface has at least one recess therein for receiving the playing piece. A manually manipulatable member overlies and is in proximity to the playing surface for selective sliding movement thereover by players of the game. The manually manipulatable member is opaque and has an aperture therein for receiving the playing piece in gravity abutment with the playing surface. The aperture in the manually manipulatable member is larger than the playing piece whereby the playing piece can drop through the aperture into the recess in the playing surface when aligned therewith.

23 Claims, 2 Drawing Figures

BALL GAME WITH ALIGNABLE APERTURES

BACKGROUND AND SUMMARY OF THE INVENTION

This invention relates to games and particularly to game apparatus which involves manual manipulation by players of the game as well as requiring mental retaining capabilities to successfully play the game by remembering prior action during play.

Games have been provided, such as board games, card games, or the like, where the players during play of cards or game pieces must remember actions during the play of the game in order to successfully win the game or accumulate points or scores as play progresses. The present invention is directed to a game apparatus of the character described which employs a mechanical apparatus for moving playing pieces thereover and dropping the playing pieces through "hidden" apertures or recesses during play and including means for creating "challenges" during play whereby players attempt to determine relative positions of hidden playing pieces.

In the exemplary embodiment of the invention, the game apparatus includes a base for positioning on a supporting surface. The base has a raised generally flat playing surface with a plurality of apertures therein whereby playing pieces, such as balls, can be moved over the playing surface and dropped through the apertures therein. A manually manipulatable member in the form of a generally flat plate is positionable on top of the playing surface for sliding thereover by the players of the game. The manually manipulatable member has a plurality of apertures therein for receiving the playing pieces in gravity abutment with the top of the playing surface of the base. The manually manipulatable member is opaque so as to preclude visualization of the apertures in the playing surface, and opaque caps are positionable on top of the manually manipulatable member about the apertures therein covering any playing pieces which are disposed in the apertures of the manipulatable member. Operating means is provided and connected between the manually manipulatable member and the base for selective operation by the players of the game to move the member over the playing surface. The operating means includes a separate moving mechanism for each player to independently move the manually manipulatable member relative to the playing surface to move the "hidden" playing pieces over the playing surface in an attempt to drop the playing pieces through the apertures in the playing surface. Each moving mechanism includes a take-up reel rotatably mounted on the base and selectively rotatable by a player of the game, and a cable wrapped about the take-up reel and connected to one side of the manually manipulatable plate-like member. The crank arm is secured to the take-up reel for grasping by a player to rotate the reel.

In the preferred embodiment of the invention, both the apertures in the manually manipulatable plate-like member and the subjacent playing surface are randomly spaced and, in the embodiment shown, more apertures are provided in the raised playing surface than in the upper manipulatable member.

Other objects, features and advantages of the invention will be apparent from the following detailed description taken in connection with the accompanying drawings.

DETAILED DESCRIPTION OF THE INVENTION

Figure 1:
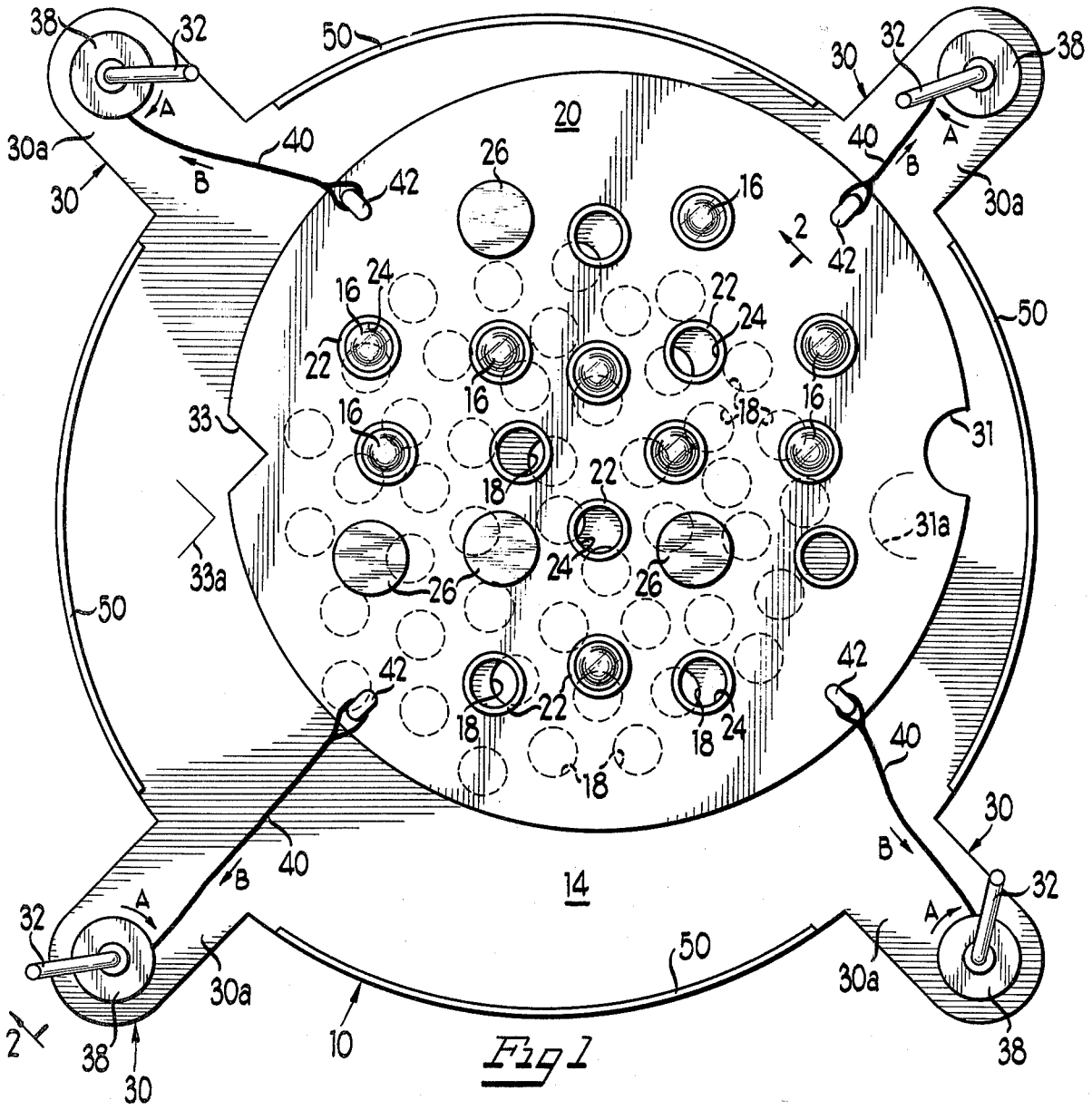
FIG. 1 is a top plan view of the game apparatus of the present invention.

Referring to the drawings in greater detail, the game apparatus of the present invention includes a generally circular frame, generally designated 10, which has an annular upstanding flange 12 generally about the periphery thereof for mounting a generally flat playing surface 14 in a raised disposition above a supporting surface such as a tabletop, or the like. A plurality of playing pieces 16 in the forms of balls are rollingly supportable on top of the playing surface 14. The playing surface has a plurality of randomly spaced recesses or apertures 18 through which the balls 16 can fall when aligned therewith during play of the game.

Figure 2:
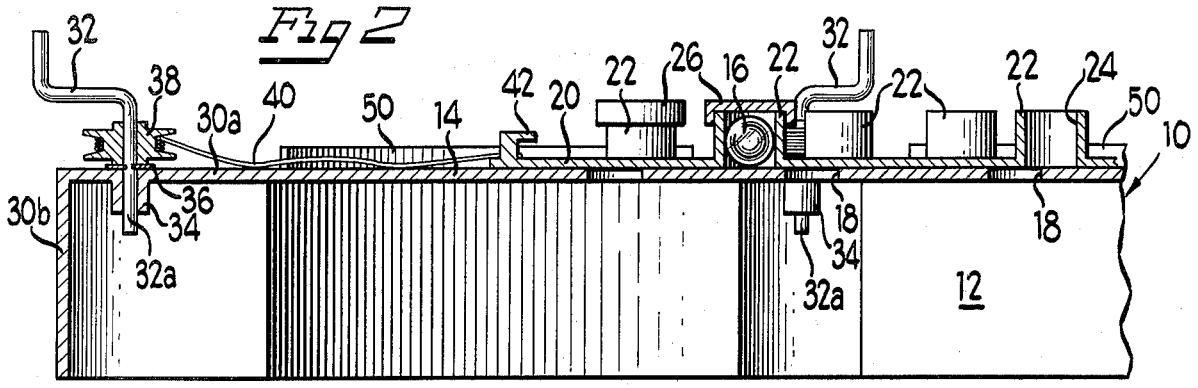
FIG. 2 is a fragmented vertical section taken generally along 2—2 of FIG. 1.

A generally flat, circular plate-like manually manipulatable member 20 is positioned on top of the playing surface 14 for selective sliding movement thereover. The manually manipulatable member 20 has a plurality of upstanding cylindrical bosses 22 surrounding apertures 24 extending through the plate-like member 20. The bosses 22 and apertures 24 are sized so as to receive the balls 16 so that the balls either can rest by gravity on top of the playing surface 14 (as seen by the ball in FIG. 2) or fall through the apertures 24 in the manually manipulatable member 20 and through the apertures 18 in the playing surface 14 when aligned therewith. The plate-like manually manipulatable member 20 preferably is opaque so as to preclude visualization therethrough of the underlying apertures 18 in the playing surface 14 when the member 20 covers the apertures 18.

In addition, a plurality of cylindrical cap members 26 are positionable over at least some of the cylindrical bosses 22 on top of the plate-like member 20 to cover any balls 16 therein. To this end, the caps 26 preferably are opaque. As shown in FIG. 1, only four caps 26 are provided, for instance to be color coded to four players of the game, which the players can selectively position over the top of one of the cylindrical bosses 22 on top of the plate-like member 20 to conceal a selected ball thereunder. Of course, any number of caps may be employed, color coded or not, depending upon various schemes of playing the game of the present invention.

With the above described structure, it can be seen that the manually manipulatable member 20 can be selectively moved over the playing surface 14 in a sliding fashion so as to move the balls 16 therewith over the top of the playing surface 14 with those caps 26 which are positioned to conceal balls thereunder maintained in covering relationship over the balls by the upstanding bosses 22 on top of the movable plate-like member 20. The balls 16 will rest by gravity on top of the playing surface 14 until one or more of the apertures 24 in the movable member 20 is in alignment with one of the apertures 18 in the playing surface 14 whereupon the respectively aligned balls 16 will fall therethrough into the underside of the base 10 within the upstanding peripheral flange 12. To this end, preferably the base 10, including the upstanding flange 12 and playing surface 14, also is opaque as are the movable plate-like member 20 and caps 26 so as to preclude visualization by the players of the game as to which or how many balls 16 have dropped through the apertures 18 in the playing surface to the underside of the base 10. As seen in FIG. 1, the apertures 18 in the playing surface 14 as well as the apertures 24 (and bosses 22) in the movable member 20 are randomly disposed so as not to define a given pattern ascertainable by the players of the game whereby the players might calculate their respective movements of member 20 as might be dictated by a non-random pattern of apertures.

In order to set the game apparatus at the beginning of play so that none of the apertures 24 in the movable member 20 are in alignment with any apertures 18 in the playing surface 14, indexing means is provided. More particularly, the movable member 20 has a rounded notch 31 on one side thereof and a triangular notch 33 on the other side thereof diametrically opposite the notch 31. Similarly shaped indicating means 31*a* and 33*a* are formed on the top of the playing surface 14 corresponding to the notches 31 and 33, respectively, so as to define the initial relative positioning of the movable member 20 and the playing surface 14, and the notches 18 therein. In this manner, when the indexing means, as described, are in alignment, any balls 16 placed into the upstanding cylindrical bosses 22 on top of the movable member 20 will rest by gravity on top of the playing surface 14 out of alignment with the apertures 18 in the playing surface, as shown by the balls 16 in FIG. 2.

Operating means is provided, connected between the manually manipulatable plate member 20 and the base 10 for selective operation by the players of the game to slide the member 20 in any direction over the top of the playing surface 14. More particularly, the operating means includes a separate moving mechanism, generally designated 30, for each player of the game to independently move the sliding member 20. Each mechanism 30 protrudes radially outwardly of the base 10 as seen in FIG. 1 and includes an upper wall portion 30*a* formed as a radial extension of the playing surface 14 and a downwardly depending wall portion 30*b* formed integral with the upstanding wall or flange 12 of the base. A crank arm 32, for manual rotation by a player of the game, is journalled in a boss 34 depending from the underside of the wall portion 30*a* for rotation relative thereto. A snap washer 36 is clipped within a complementary groove intermediate the ends of a depending leg portion 32*a* of the crank arm 32. The snap washer 36 bears against the top of the wall portion 30*a* to define the vertical position of the crank arm 32. A take-up reel 38 is fixed to the depending leg portion 32*a* of the crank arm 32 for rotation therewith, above the snap washer 36 and the upper wall portion 30*a*. The take-up reel 38 is in the form of a pulley and has a cable 40 wrapped thereabout at one end of the cable, with the other end of the cable tied about a hook 42 protruding upwardly from the slidable member 20 along a peripheral point thereof. The moving mechanisms 30 and the hooks 42 are equally angularly spaced, four in number as shown in FIG. 1. Thus, a player of the game can grasp the crank arm 32 and rotate the take-up reel 38, as shown in a clockwise direction by arrows A in FIG. 1, and wind the cable 40 onto the take-up reel in the direction of arrows B to slide the movable member 20 therewith. The sliding member 20 therefore is movable in all directions over the top of the playing surface 14 as manipulated by the plural moving mechanisms 30. Four arcuate ribs 50 protrude upwardly from the playing surface about the periphery thereof, between the moving mechanisms 30, to limit the extent of movement of the slidable member 20.

The balls 16 can be color coded for the respective players of the game to facilitate various schemes of play. For instance, the embodiment of the game apparatus shown in FIG. 1 includes twenty upstanding bosses 22 of the moving plate 20 and respective apertures 24. Twenty balls 16 can be provided for positioning within the upstanding bosses 22 and color coded to the various players of the game, for instance five similarly colored balls for each of four different players, with four corresponding moving mechanisms 30. In the four shown, more apertures 18 are provided in the playing surface 14 than in slidable member 20, although any number of apertures 18 can be provided.

Numerous schemes of play can be employed with the game apparatus of the present invention, particularly with the sliding member 20 and caps 26 being opaque, so as to hide the position of the balls 16 when disposed either within the upstanding bosses 22 in gravity abutment with the top of the playing surface 14 or after one or more balls have fallen through the apertures 18 in the playing surface into the space on the underside of the opaque base 10. For instance, "challenges" could be provided during play of the game whereby a player (for instance, prior to his turn at operating one of the moving mechanisms 30) can challenge another player as to whether or not a ball 16 remains within a particular upstanding boss 22 covered by one of the opaque caps 26. If the player is successful in his "challenge," he may be given an award such as acquiring the ball if still remaining within the upstanding boss) or be given a penalty such as losing his turn to operate his respective moving mechanism 30 if a ball is not in the upstanding boss. If the caps are color coded to the respective players as described above, a challenge can be made to a particular player, bluffs can be played, and the challenged player could be awarded or penalized. Challenges also can be created as to the number of balls, or the number of balls of a particular color, which might have fallen through the apertures 18 in the playing surface into the area on the underside of the base 10. Other schemes of play can be devised such as permitting a player to operate any one or more of the operating mechanisms 30, such as being awarded if the player can guess or determine the number of balls which have been dropped through the apertures 18 in the playing surface during a turn of play or at any given point of play, or, conversely, how many balls 16 still remain disposed within the upstanding bosses 22 on top of the playing surface 14. Should a player make a "challenge" as to whether or not a ball (or a ball of a particular color) still remains within one of the upstanding bosses 22 when the respective cap 26 is removed therefrom, the cap can be replaced so that the players must remember the particular disposition of the balls for subsequent challenges to determine the disposition of one or more of the balls or one or more balls of a particular color. Of course, many other schemes of play are contemplated by the game apparatus as shown and described herein.

The foregoing detailed description has been given for clearness of understanding only and no unnecessary limitations should be understood therefrom as some modifications will be obvious to those skilled in the art.

We claim:

1. A game apparatus, comprising:

a base for positioning on a supporting surface and having means defining an upper playing surface for supporting at least one playing piece for movement thereover, and including means defining at least one recess in said playing surface for receiving the playing piece;

at least one playing piece movably supportable on said base support;

a manually manipulatable member overlying and in proximity to said playing surface for selective movement thereover by players of the game, said manually manipulatable member having an aperture therein for receiving the playing piece in gravity abutment with the playing surface, the aperture being larger than the playing piece whereby the playing piece can drop through the aperture in said manually manipulatable member into the recess in said playing surface when aligned therewith; and operating means connected between said manually manipulatable member and said base and selectively operable by the players of the game to move the manually manipulatable member in all directions in the plane of said member.

2. The game apparatus of claim 1 wherein said manually manipulatable member is opaque so as to preclude visualization of the recess in said playing surface through said member.

3. The game apparatus of claim 2 including a plurality of said recesses in said playing surface, and said manually manipulatable member is of sufficient size to cover a substantial number of said recesses when the member is in at least one position relative to the playing surface.

4. The game apparatus of claim 1 wherein said playing surface is generally flat and said manually manipulatable member is a plate-like member slidably movable over the playing surface.

5. The game apparatus of claim 1 wherein the recess in said playing surface is of sufficient depth to receive substantially the entire playing piece so that the playing piece when in the recess does not interfere with movement of said manually manipulatable member.

6. The game apparatus of claim 5 wherein said playing surface is mounted on said base in a raised disposition above a supporting surface and said recess comprises an aperture through which the playing piece can fall through the playing surface.

7. The game apparatus of claim 1 including an opaque cap for covering the playing piece when the playing piece is disposed in the aperture in the manually manipulatable member.

8. The game apparatus of claim 7 including a plurality of caps and wherein said caps are color coded to particular players of the game.

9. The game apparatus of claim 7 including means on the top of said manually manipulatable member engageable with said cap to hold the cap about the aperture covering the playing piece.

10. A game apparatus comprising:

a base for positioning on a supporting surface having means defining an upper playing surface for supporting a plurality of playing pieces for movement thereover and including means defining at least one recess in said playing surface for receiving a playing piece;

a plurality of playing pieces movably supported on said playing surface;

a manually manipulatable member overlying and in proximity to said playing surface for selective movement thereover by the players of the game, said manually manipulatable member having a plurality of apertures therein for receiving playing pieces in gravity abutment with the playing surface, the apertures being larger than the playing piece whereby a playing piece can drop through the aperture into the recess;

a plurality of opaque caps for covering the playing pieces disposed in the apertures in the manually manipulatable member to preclude visualization of which playing piece may have dropped into the recess in the playing surface; and means on said manually manipulatable member engageable with said caps to hold the caps about the aperture thereby covering the playing piece.

11. The game apparatus of claim 10 wherein said playing pieces are color coded to particular players of the game.

12. A game apparatus, comprising:

a base for positioning on a supporting surface having means defining an upper playing surface for supporting at least one playing piece for movement thereover and including means defining at least one recess in said playing surface for receiving a playing piece;

at least one playing piece movably supported on said playing surface;

a manually manipulatable member overlying and in proximity to said playing surface for selective movement thereover by the players of the game, said manually manipulatable member having an aperture therein for receiving the playing piece in gravity abutment with the playing surface, the aperture being larger than the playing piece whereby a playing piece can drop through the aperture into the recess; and operating means connected between said manually manipulatable member and said base member and selectively operable by the players of the game to move the manually manipulatable member relative to the playing surface, said operating means including a plurality of separate moving mechanisms for independently moving the manually manipulatable member in a given direction.

13. The game apparatus of claim 12 wherein each of said moving mechanisms includes a take-up reel rotatably mounted on the base and selectively rotatable by a player of the game, and a cable wrapped about the take-up reel and connected to one side of the manually manipulatable member.

14. The game apparatus of claim 13 wherein said take-up reel has a crank arm graspable by a player to rotate the reel.

15. A game apparatus, comprising:

a base for positioning on a supporting surface and having means defining an upper generally flat playing surface for supporting a plurality of playing pieces for movement thereof, and including means defining a plurality of spaced recesses randomly spaced from one another for receiving the playing pieces;

a plurality of playing pieces movably supportable on said playing surface; and a plate-like manually manipulatable member positionable on top of said playing surface for selective sliding movement thereover in all directions in the plane parallel to the plane of the playing surface, said manually manipulatable member having a plurality of apertures therein for receiving the playing pieces in gravity abutment with the playing surface, the apertures in said member being randomly spaced from the recesses in said playing surface and larger than the playing pieces whereby the playing pieces can drop through the apertures into the recesses in said playing surface when aligned therewith.

16. The game apparatus of claim 15 wherein there are a larger number of recesses in said playing surface than apertures in said manually manipulatable member.

17. The game apparatus of claim 15 wherein said playing surface is mounted on said base in a raised disposition above a supporting surface, and said recesses comprise apertures through which the playing pieces can drop through the playing surface.

18. A game apparatus, comprising:

a base for positioning on a supporting surface and having means defining an upper generally flat playing surface for supporting a plurality of playing pieces for movement thereof, and including means defining a plurality of spaced recesses for receiving the playing pieces;

a plurality of playing pieces movably supportable on said playing surface;

a plate-like manually manipulatable member positionable on top of said playing surface for selective sliding movement thereover by players of the game, said manually manipulatable member having a plurality of apertures therein for receiving the playing pieces in gravity abutment with the playing surface, the apertures in said member being larger than the playing pieces whereby the playing pieces can drop through the apertures into the recesses in said playing surface when aligned therewith; and a plurality of opaque caps for covering the playing pieces when the playing pieces are disposed in the apertures in the manually manipulatable member.

19. The game apparatus of claim 18 wherein said caps are color coded to particular players of the game.

20. A game apparatus, comprising:

a base for positioning on a supporting surface and having means defining an upper generally flat playing surface for supporting a plurality of playing pieces for movement thereof, and including means defining a plurality of spaced recesses for receiving the playing pieces;

a plurality of playing pieces movably supportable on said playing surface;

a plate-like manually manipulatable member positionable on top of said playing surface for selective sliding movement thereover by players of the game, said manually manipulatable member having a plurality of apertures therein for receiving the playing pieces in gravity abutment with the playing surface, the apertures in said member being larger than the playing pieces whereby the playing pieces can drop through the apertures into the recesses in said playing surface when aligned therewith; and operating means connected between said manually manipulatable member and said base and selectively operable by the players of the game to move the manually manipulatable member in all directions in the plane of said member.

21. The game apparatus of claim 20 wherein said operating means includes a plurality of separate, angularly spaced moving mechanisms to independently move the manually manipulatable member in a given direction, each of said moving mechanisms including a take-up reel rotatably mounted on the base and selectively rotatable by a player of the game, and a cable wrapped the take-up reel and connected to one side of the manually manipulatable member.

22. The game apparatus of claim 20 wherein said playing pieces comprise spherical objects for rolling over said playing surface.

23. The game apparatus of claim 20 wherein said playing pieces are color coded to respective players of the game.

* * * * *